US011761648B2

(12) United States Patent
Zhan

(10) Patent No.: US 11,761,648 B2
(45) Date of Patent: Sep. 19, 2023

(54) HUMIDIFIER WITH AIR GUIDING ARRANGEMENT

(71) Applicant: Shenzhen Chenbei Technology Co., Ltd., Shenzhen (CN)

(72) Inventor: Xuequn Zhan, Shenzhen (CN)

( * ) Notice: Subject to any disclaimer, the term of this patent is extended or adjusted under 35 U.S.C. 154(b) by 271 days.

(21) Appl. No.: 17/125,982

(22) Filed: Dec. 17, 2020

(65) Prior Publication Data

US 2021/0190342 A1 Jun. 24, 2021

(30) Foreign Application Priority Data

Dec. 18, 2019 (CN) ..... 201911308326.X

(51) Int. Cl.

| | |
|---|---|
| ***F24F 6/06*** | (2006.01) |
| ***F24F 6/00*** | (2006.01) |
| ***F24F 13/065*** | (2006.01) |
| ***F24F 13/08*** | (2006.01) |

(52) U.S. Cl.

CPC ..... *F24F 6/00* (2013.01); *F24F 13/065* (2013.01); *F24F 13/08* (2013.01); *F24F 2006/006* (2013.01); *F24F 2006/008* (2013.01); *F24F 2006/065* (2013.01)

(58) Field of Classification Search

CPC .. F24F 6/06; F24F 13/065; F24F 13/08; F24F 2006/006; F24F 2006/008; F24F 2006/065; F24F 11/89; F24F 6/12; F24F 11/30; F24F 11/50; F24F 13/082; F24F 13/28

See application file for complete search history.

(56) References Cited

U.S. PATENT DOCUMENTS

| | | | | | |
|---|---|---|---|---|---|
| 2,211,407 | A * | 8/1940 | Christensen | F24F 6/025 | 392/405 |
| 3,420,509 | A * | 1/1969 | Briggin | F24F 6/04 | 261/142 |
| 3,687,424 | A * | 8/1972 | Katzman | F24F 6/06 | 261/119.1 |
| 3,787,036 | A * | 1/1974 | Hastings | F24F 6/06 | 261/92 |
| 3,873,806 | A * | 3/1975 | Schossow | F24F 6/025 | 422/106 |
| 4,203,027 | A * | 5/1980 | O'Hare | A61M 16/16 | 261/142 |
| 4,943,704 | A * | 7/1990 | Rabenau | A61M 16/142 | 261/142 |

(Continued)

*Primary Examiner* — Stephen Hobson
(74) *Attorney, Agent, or Firm* — Tsz Lung Yeung

(57) ABSTRACT

A humidifier includes a main housing, a fan unit and an air guiding arrangement, which includes a guiding roller and a partitioning assembly. The partitioning assembly is supported in the main housing at a position adjacent to the guiding roller to substantially enclose the water storage compartment. The partitioning assembly defines at least one air slot and an air passage channel, wherein when the fan unit and the guiding roller are driven to rotate, air is drawn from the air inlet and guided to pass through the air slot to reach the water storage compartment for effectively mixing with the water in the water storage compartment to form a predetermined amount of mist. The mist is arranged to pass through the partitioning assembly through the air passage channel and the fan unit, and eventually discharged out of the main housing.

15 Claims, 12 Drawing Sheets

(56) References Cited

U.S. PATENT DOCUMENTS 5,247,604 A * 9/1993 Chiu ..... F22B 1/284 261/DIG. 65
5,336,156 A * 8/1994 Miller ..... A61M 16/16 119/314
5,783,117 A * 7/1998 Byassee ..... F24F 6/043 261/107
5,792,390 A * 8/1998 Marino ..... F24F 6/00 215/359
6,832,753 B1 * 12/2004 Huang ..... F24F 6/06 261/92
7,335,157 B2 * 2/2008 Czupich ..... A61M 16/109 600/22
7,467,786 B2 * 12/2008 Jae-Bong ..... F24F 6/02 261/81
7,712,249 B1 * 5/2010 Modlin ..... A01M 1/2033 43/132.1
8,313,569 B2 * 11/2012 Park ..... A61L 9/122 96/234
2007/0152356 A1 * 7/2007 Huang ..... F24F 6/00 261/81
2008/0127820 A1 * 6/2008 Park ..... A61L 9/122 55/438
2010/0170511 A1 * 7/2010 Payne ..... A61M 16/168 137/423
2011/0084415 A1 * 4/2011 Kim ..... F24F 6/06 261/92
2012/0161343 A1 * 6/2012 Ha ..... F24F 6/06 261/92
2012/0297975 A1 * 11/2012 Joung ..... F24F 6/06 95/1
2014/0083524 A1 * 3/2014 Huang ..... F24F 6/00 137/409
2014/0216259 A1 * 8/2014 Iwaki ..... F24F 11/64 96/18
2015/0008599 A1 * 1/2015 Hou ..... F24F 6/12 261/127
2015/0114233 A1 * 4/2015 Lee ..... F24F 6/06 261/114.5
2015/0115481 A1 * 4/2015 Jang ..... F24F 6/06 261/24
2015/0115482 A1 * 4/2015 Jang ..... F24F 6/16 261/92
2016/0059175 A1 * 3/2016 Bae ..... B01D 47/16 261/30
2016/0169542 A1 * 6/2016 Yoon ..... F24F 13/20 261/72.1
2016/0175757 A1 * 6/2016 Yoon ..... F24F 13/20 261/30
2017/0074532 A1 * 3/2017 Kim ..... F24F 13/20
2017/0122586 A1 * 5/2017 Son ..... F24F 6/06
2017/0122607 A1 * 5/2017 Son ..... F24F 13/20
2017/0363308 A1 * 12/2017 McDonnell ..... F24F 11/0008
2018/0180310 A1 * 6/2018 Abel ..... F24H 9/2007
2019/0134555 A1 * 5/2019 Ramos De La Fuente ..... F24F 8/192
2020/0182494 A1 * 6/2020 Fitsch ..... F24F 8/125

* cited by examiner

HUMIDIFIER WITH AIR GUIDING ARRANGEMENT

CROSS REFERENCE TO RELATED APPLICATION

This is a non-provisional application which claims priority to a Chinese patent application having an application number of CN 201911308326.X, and a filing date of Dec. 18, 2019, the entire contents of which is hereby incorporated by reference.

BACKGROUND

Field of Invention

Embodiments of the present disclosure relates to a humidifier, and more particularly to a humidifier comprising an air guiding arrangement which is capable of facilitating effective mix of air and water in a water storage compartment.

Description of Related Arts

With the advance of technology, humidifiers have been widely utilized around the world for increasing humidity in a designated space, such as a living room or a bedroom. There exist many kinds of humidifiers. A conventional humidifier may comprise a main housing having an air inlet, an air outlet and a water receiving cavity for storing a predetermined amount of water, and a fan unit. The fan unit may draw air to flow from the air inlet toward the air outlet. The air in the main housing may mix with the water stored in the water receiving cavity for forming mist. The mist may be blown by the fan unit to be discharged out of the main housing through the air outlet.

A major disadvantage of the conventional humidifiers such as the one described above is that the air drawn from the air inlet may freely circulate in the main housing. As a result, this may affect the performance or effectiveness by which air is mixed with water stored in the water receiving cavity.

As a result, there is a need to develop a humidifier which is capable of facilitating effective mix of air and water in a water storage compartment.

SUMMARY

Implementations of the present disclosure provide a humidifier comprising an air guiding arrangement which is capable of facilitating effective mix of air and water in a water storage compartment.

In one aspect of the present disclosure, it provides a humidifier, comprising:

- a main housing having an air inlet, an air outlet, a receiving cavity, and a water storage compartment for storing a predetermined amount of water;
- a fan unit supported in the main housing for drawing air to flow from the air inlet to the air outlet; and
- an air guiding arrangement, which comprises:
- a guiding roller rotatably supported in the water storage compartment of the main housing; and
- a partitioning assembly supported in the receiving cavity of the main housing at a position adjacent to the guiding roller to substantially enclose the water storage compartment, the partitioning assembly defining at least one air slot and an air passage channel, wherein when the fan unit and the guiding roller are driven to rotate, air is drawn from the air inlet and guided to pass through the air slot to reach the water storage compartment for effectively mixing with the water in the water storage compartment to form a predetermined amount of mist, the mist being arranged to pass through the partitioning assembly through the air passage channel and the fan unit, and eventually discharged out of the main housing through the air outlet.

This summary presented above is provided merely to introduce certain concepts and not to identify any key or essential features of the claimed subject matter.

DETAILED DESCRIPTION OF THE PREFERRED EMBODIMENT

Figure 1:
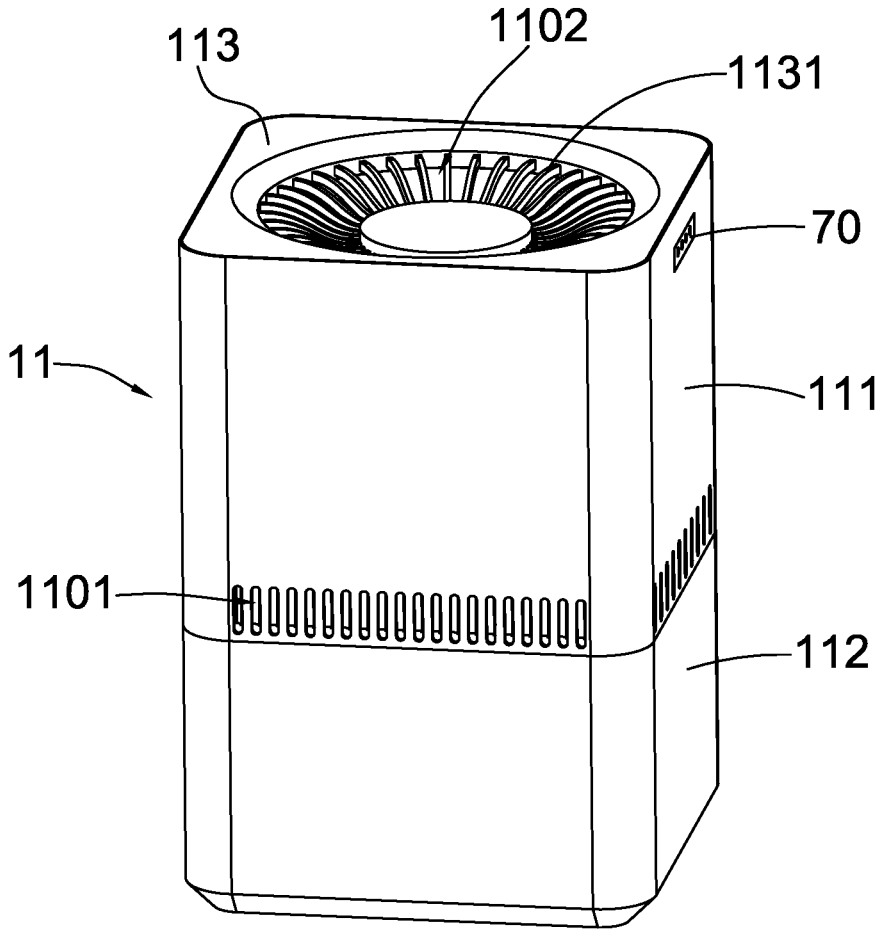
FIG. 1 is a perspective view of a humidifier according to a preferred embodiment of the present invention.

The following detailed description of the embodiments is the preferred mode of carrying out the present disclosure. The description is not to be taken in any limiting sense. It is presented for the purpose of illustrating the general principles of embodiments of the present disclosure.

It should be appreciated that the terms "install", "connect", "couple", and "mount" in the following description refer to the connecting relationship in the accompanying drawings for easy understanding of embodiments of the present disclosure. For example, the connection can refer to permanent connection or detachable connection. Furthermore, "connected" may also mean direct connection or indirect connection, or connection through other auxiliary components. Therefore, the above terms should not be an actual connection limitation of the elements of embodiments of the present disclosure.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of embodiments of the present disclosure without limiting the actual location or orientation of embodiments of the present disclosure. Therefore, the above terms should not be an actual location limitation of the elements of embodiments of the present disclosure.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of embodiments of the present disclosure.

Referring to FIG. 1 to FIG. 12 of the drawings, a humidifier according to a preferred embodiment of the present invention is illustrated. Broadly, the humidifier may comprise a main housing 11, a fan unit 30, and an air guiding arrangement 60.

The main housing 11 may have an air inlet 1101, an air outlet 1102, a receiving cavity 110, and a water storage compartment 120 for storing a predetermined amount of water.

The fan unit 30 may be supported in the main housing 11 for drawing air to flow from the air inlet 1101 to the air outlet 1102.

The air guiding arrangement 60 may comprise a guiding roller 21 and a partitioning assembly 13. The guiding roller 21 may be rotatably supported in the water storage compartment 120 of the main housing 11.

The partitioning assembly 13 may be supported in the receiving cavity 110 of the main housing 11 at a position adjacent to the guiding roller 21 to substantially enclose the water storage compartment 120. The partitioning assembly 13 may define a plurality of (but at least one) air slots 1322 and an air passage channel 1301, wherein when the fan unit 30 and the guiding roller 21 are driven to rotate, air is drawn from the air inlet 1101 and guided to pass through the air slots 1322 to reach the water storage compartment 120 for effectively mixing with the water in the water storage compartment 120 for forming a predetermined amount of mist. The mist may then be arranged to pass through the partitioning assembly 13 through the air passage channel 1301 and the fan unit 30 and is eventually discharge out of the main housing 11 through the air outlet 1102.

According to the preferred embodiment of the present invention, the main housing 11 may have a receiving cavity 110 for storing mechanical and electrical components therein. The main housing 11 may be arranged to stand on a flat surface and may comprise a top panel 113, an upper housing member 111, a lower housing member 112 provided underneath the upper housing member 111, and a water tank 12 received in the lower housing member 112. The water storage compartment 120 may be formed in the water tank 12 for storing a predetermined of water. As shown in FIG. 1 of the drawings, the air inlet 1101 may be formed on a lower portion of the upper housing member 111 while the air outlet 1102 may be formed on the top panel 113 of the main housing 11. The top panel 113 may be provided on top of the upper housing member 111. The top panel 113 may comprise a plurality of top guiding blades 1131 formed at the air outlet 1102 for guiding a flow path of the vapor/mist flowing out of the main housing 11.

The fan unit 30 may be mounted at a position above the partitioning assembly 13. The fan unit 30 may comprise a main frame 31 having a mounting cavity 311, a supporting frame 33 mounted in the mounting cavity 311, a plurality of fan blades 32 rotatably connected to the supporting frame 33, a fan motor 34 mounted on the supporting frame 33 and coupled to the fan blades 32 for driving the fan blades 32 to rotate about a longitudinal axis of the main housing 11. When the fan unit 30 is activated, the fan blades 32 may be driven to rotate for drawing air to flow from the air inlet 1101 toward the air outlet 1102 through the water storage compartment 120.

As shown in FIG. 2 and FIG. 8 to FIG. 10 of the drawings, the supporting frame 33 may have a tubular frame member 330 defining a securing slot 331 therein for accommodating and supporting the fan motor 34. Moreover, the supporting frame 33 may further have a plurality of guider panels 332 spacedly provided on the tubular frame member 330 for forming a corresponding number of air conduits 333 between each two guiding panels 332. The air conduits 333 may communicate with the air outlet 1102. The fan blades 32 may be rotatably mounted in the tubular frame member 330, which may be securely mounted in the mounting cavity 311 of the main frame 31. The guider panels 332 may be stationary and may further stabilize the flow of air in the water storage compartment 120 and therefore may enhance the effectiveness and efficiency of humidifying the air in the water storage compartment 120.

Figure 2:
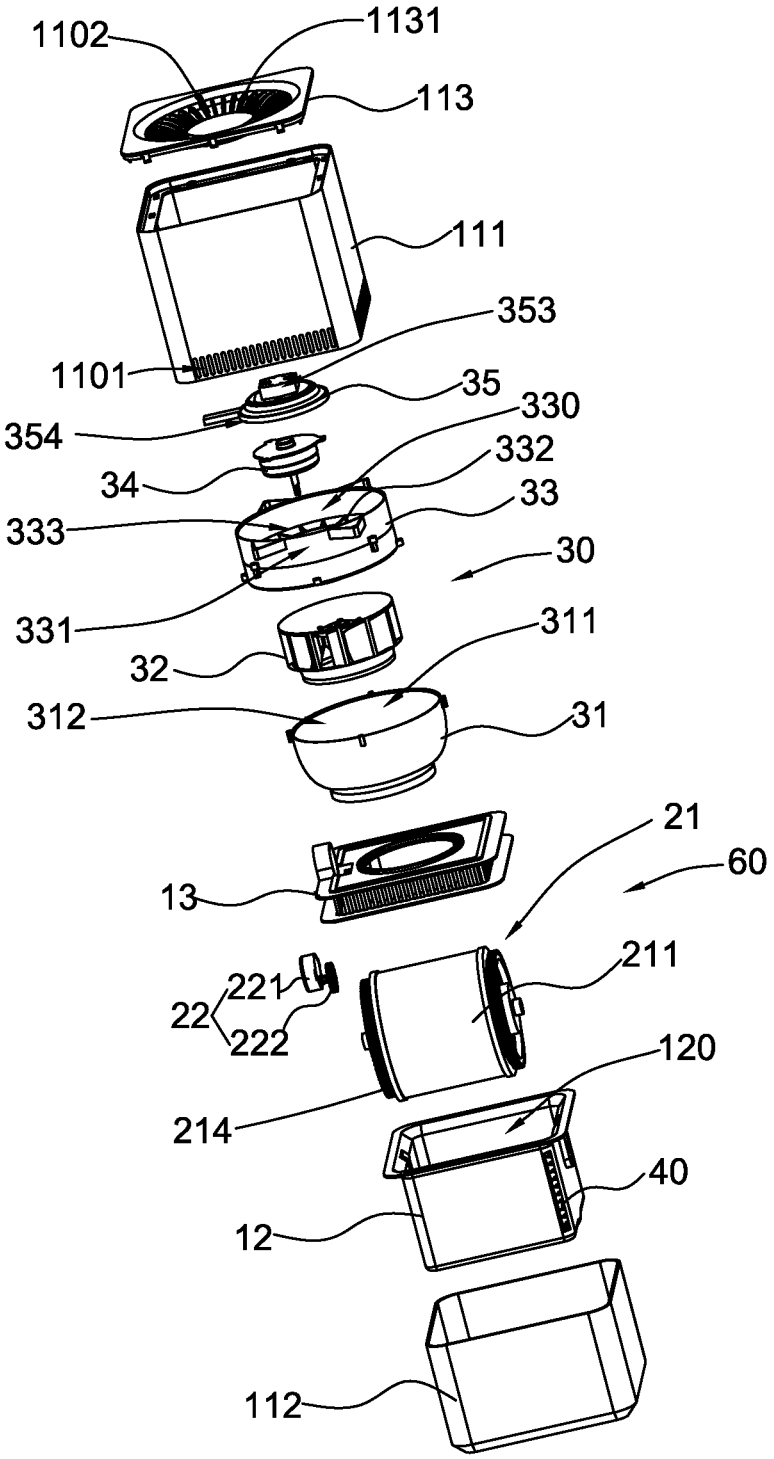
FIG. 2 is an exploded perspective view of the humidifier according to the preferred embodiment of the present invention.
Figure 9:
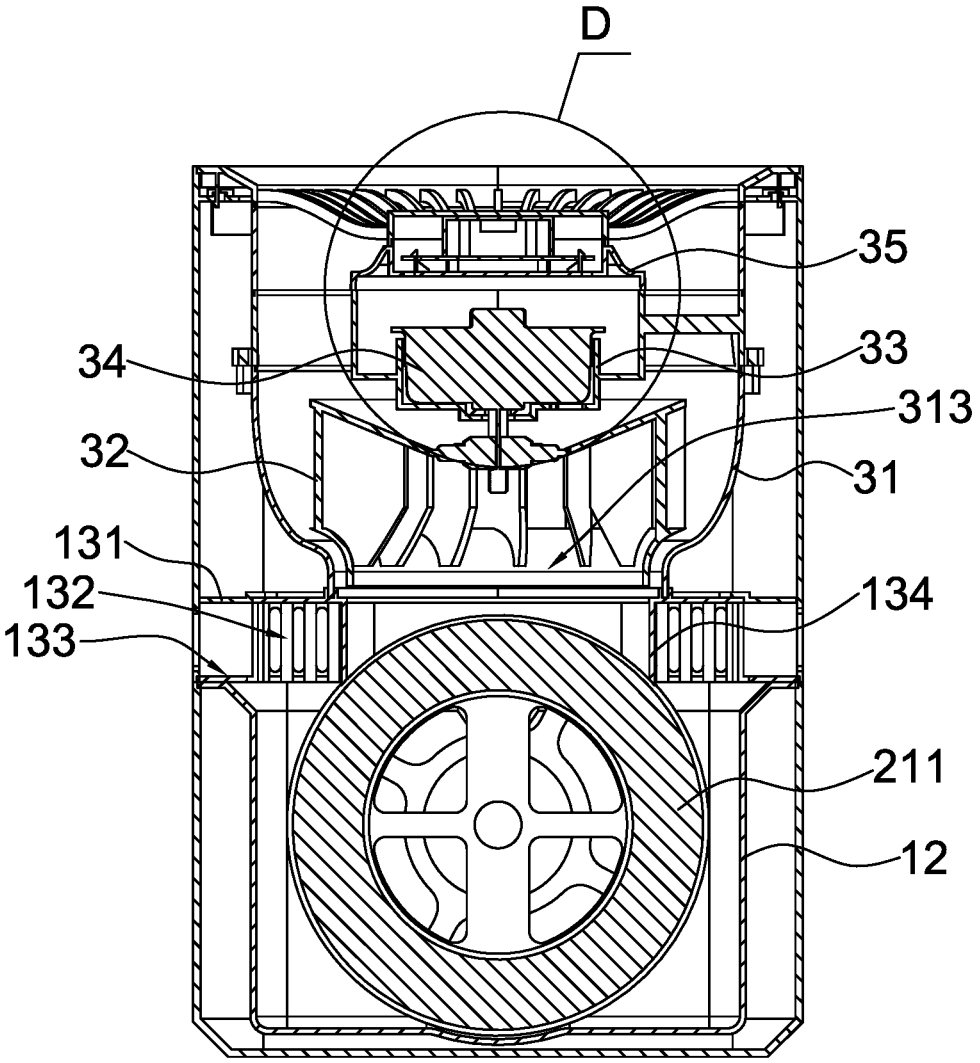
FIG. 9 is a side sectional view of the humidifier according to the preferred embodiment of the present invention.
Figure 10:
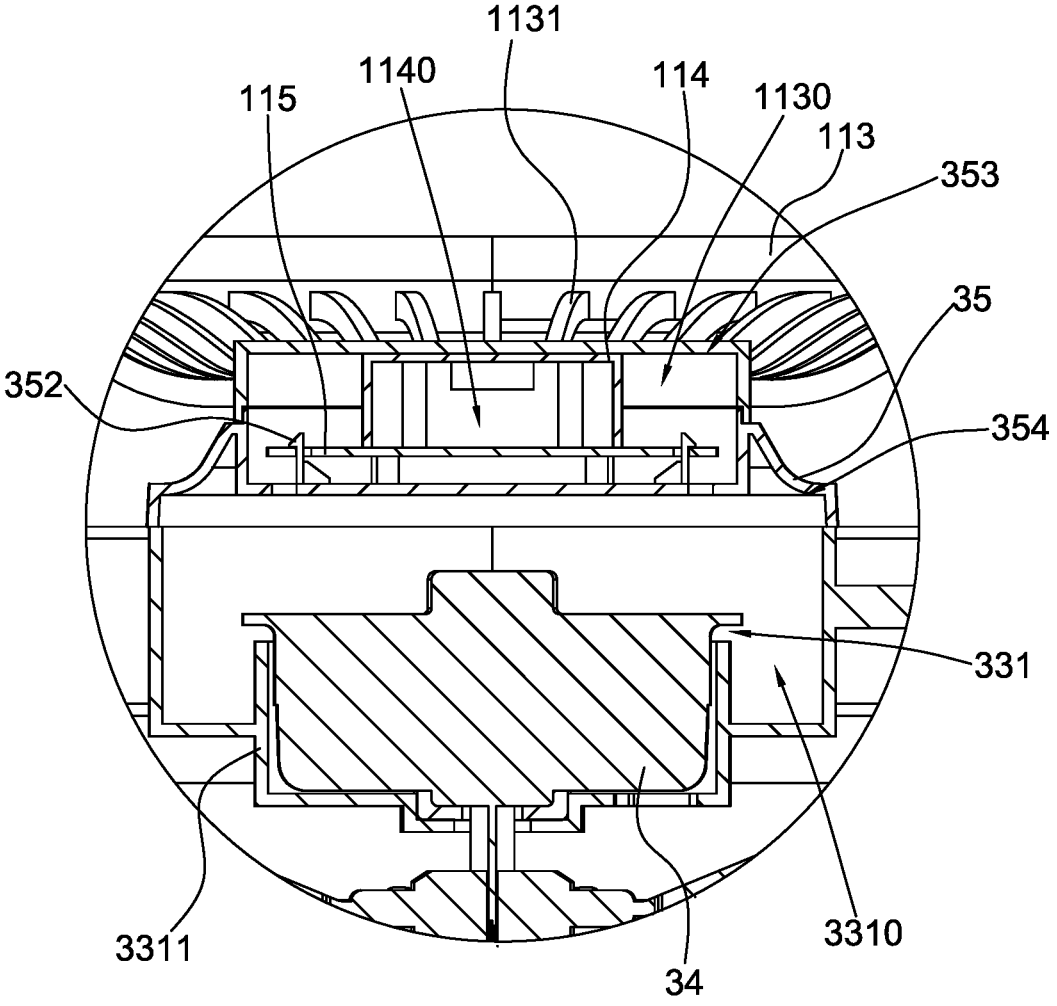
FIG. 10 is a partially enlarged sectional view of FIG. 9.

Moreover, as shown in FIG. 2 and FIG. 9 of the drawings, the fan unit 30 may further comprise a sealing member 35 mounted on the tubular frame member 330 to substantially conceal the fan motor 34 in the securing slot 331, wherein the space surrounded and concealed by the sealing member 35 and the supporting frame 33 may be defined as a sealing compartment 3310. The securing slot 331 may be surrounded by a boundary wall 3311. The sealing compartment 3310 may effectively prevent water or water vapor from contacting with the fan motor 34 so as to prevent it from being damaged by water contents.

On the other hand, the sealing member 35 may further have a sealing cavity 1130 in which when the sealing member 35 is mounted on the upper housing member 111, the sealing cavity 1130 may form a space which is sealed from water or water vapor or mist. The humidifier may further comprise a control circuitry 71 implemented on a control Printed Circuit Board (control PCB 50) received in the sealing cavity 1130. Since the sealing cavity 1130 is sealed from water, the control PCB 50 may be prevented from being damaged by water contents in the water vapor or mist.

More specifically, the sealing member 35 may have an upper sealing portion 353 and a lower sealing portion 354 extended underneath the upper sealing portion 353, wherein the sealing cavity 1130 may be formed on the upper sealing portion 353, while the lower sealing portion 354 may be connected to the tubular frame member 330 to form the sealing compartment 3310. The top panel 113 may be mounted to the sealing member 35, wherein the sealing cavity 1130 may be formed within the sealing member 35.

Furthermore, the sealing member 35 may further comprise an enclosure cap 114 and a tightening member 115 provided underneath the enclosure cap 114 to form an enclosure compartment 1140 within the space enclosed by the enclosure cap 114 and the tightening member 115. The control PCB 50 may be accommodated in the enclosure compartment 1140 for having further protection. The tightening member 115 may be secured by a plurality of latches 352 extended in the sealing member 35.

The main frame 31 may be configured as having a bowl shape and may have a top opening 312 facing the top panel 113 of the main housing 11. The main frame 31 may be reinforced and supported by the partitioning assembly 13 and sandwiched between the partitioning assembly 13 and the air outlet 1102.

Figure 3:
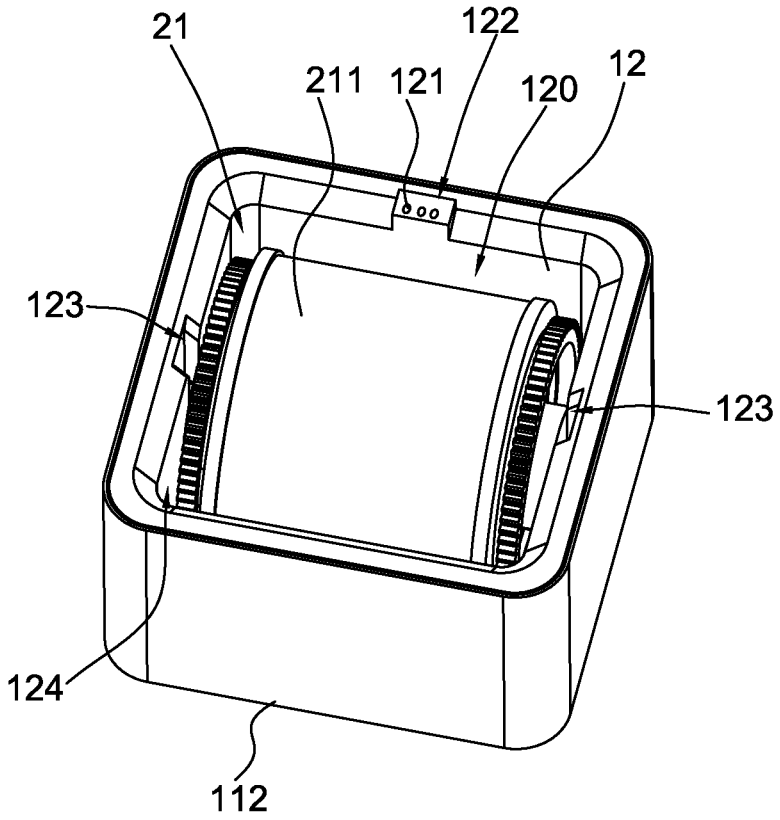
FIG. 3 is a schematic diagram of a guiding roller accommodated in a water storage compartment of the humidifier according to the preferred embodiment of the present invention.
Figure 4:
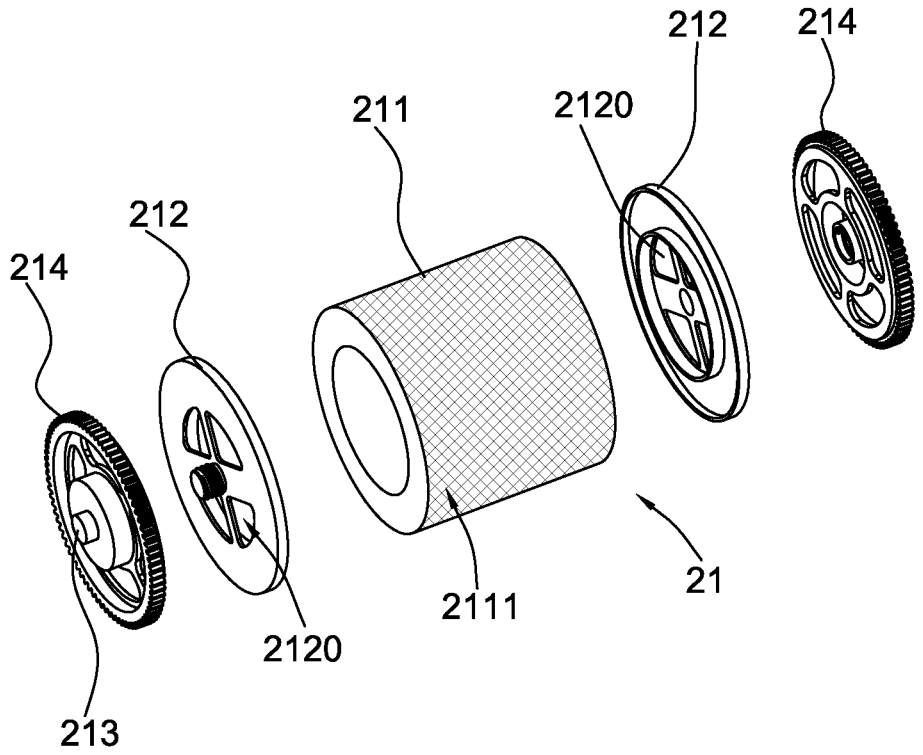
FIG. 4 is an exploded perspective view of the guiding roller of the humidifier according to the preferred embodiment of the present invention.

Referring to FIG. 3 and FIG. 4 of the drawings, the guiding roller 21 of the air guiding arrangement 60 may comprise a water absorbing roller member 211 rotatably mounted in the water storage compartment 120. In this preferred embodiment of the present invention, the water absorbing roller member 211 may be configured from rolling or folding a predetermined water absorbing material to form a substantially tubular structure. The water absorbing roller member 211 may be arranged to absorb a predetermined amount of water from the water storage compartment 120 while allowing a predetermined amount of air to pass therethrough. Thus, the water absorbing roller member 211 may be configured from water absorbing material (e.g. fabric material or water-absorbing paper material) and may have a plurality of meshes 2111 for allowing air to pass through.

More specifically, the guiding roller 21 may further comprise a plurality of reinforcing frames 212 mounted on two ends of the water absorbing roller member 211 respectively for reinforcing a structural integrity thereof and for facilitating mounting of the water absorbing roller member 211 on the water tank 12. Moreover, the guiding roller 21 may further comprise a plurality of connecting shafts 213 extended from the reinforcing frames 212 respectively, wherein the reinforcing frames 212 and the water absorbing roller member 212 may be driven to rotate about the connecting shafts 213. As shown in FIG. 4 of the drawings, each of the reinforcing frames 212 may have at least one ventilating hole 2120 for facilitating air ventilation and passage of air from the air outlet 1101 to the water storage compartment 120 when the guiding roller 21 is operated to mix air with water (described below). The water absorbing roller member 211 may be fabricated by rolling a piece of water-absorbing paper or fabric into a tubular structure having a longitudinal axis extending between the two reinforcing frames 212. In this preferred embodiment of the present invention, each of the water absorbing roller member 211, and the reinforcing frames 212 may have a substantially circular cross-sectional shape when viewed from the side, wherein a diameter of each of the reinforcing frame 212 may be larger than that of the water absorbing roller member 211. The difference in diameters between the water absorbing roller member 211 and the reinforcing frames 212 may be greater than 0.5 mm, 1 mm, 2 mm or other values.

The air guiding arrangement 60 may further comprise a driving mechanism 22 mounted in the main housing 11 and coupled to the guiding roller 21 for driving the guiding roller 21 to rotate in the water storage compartment 120. The driving mechanism 22 may comprise a driving motor 221 and a driving gear 222 coupled to the driving motor 221. The driving motor 221 may be mounted on the partitioning assembly 13 for driving the guiding roller 21.

On the other hand, the guiding roller 21 may further comprise at least one driven gear 214 operatively coupled to a corresponding connecting shaft 213, and may be arranged to engage with the driving gear 222 of the driving mechanism 22. When the driving motor 221 is operated, the driving gear 222 may be driven to rotate which in turn drives the driven gear 214 to rotate as well. The rotation of the driven gear 214 may then arranged to drive the corresponding reinforcing frame 212 to rotate. As a result, the water absorbing roller member 211 may also be driven to rotate about the connecting shafts 213.

Figure 8:
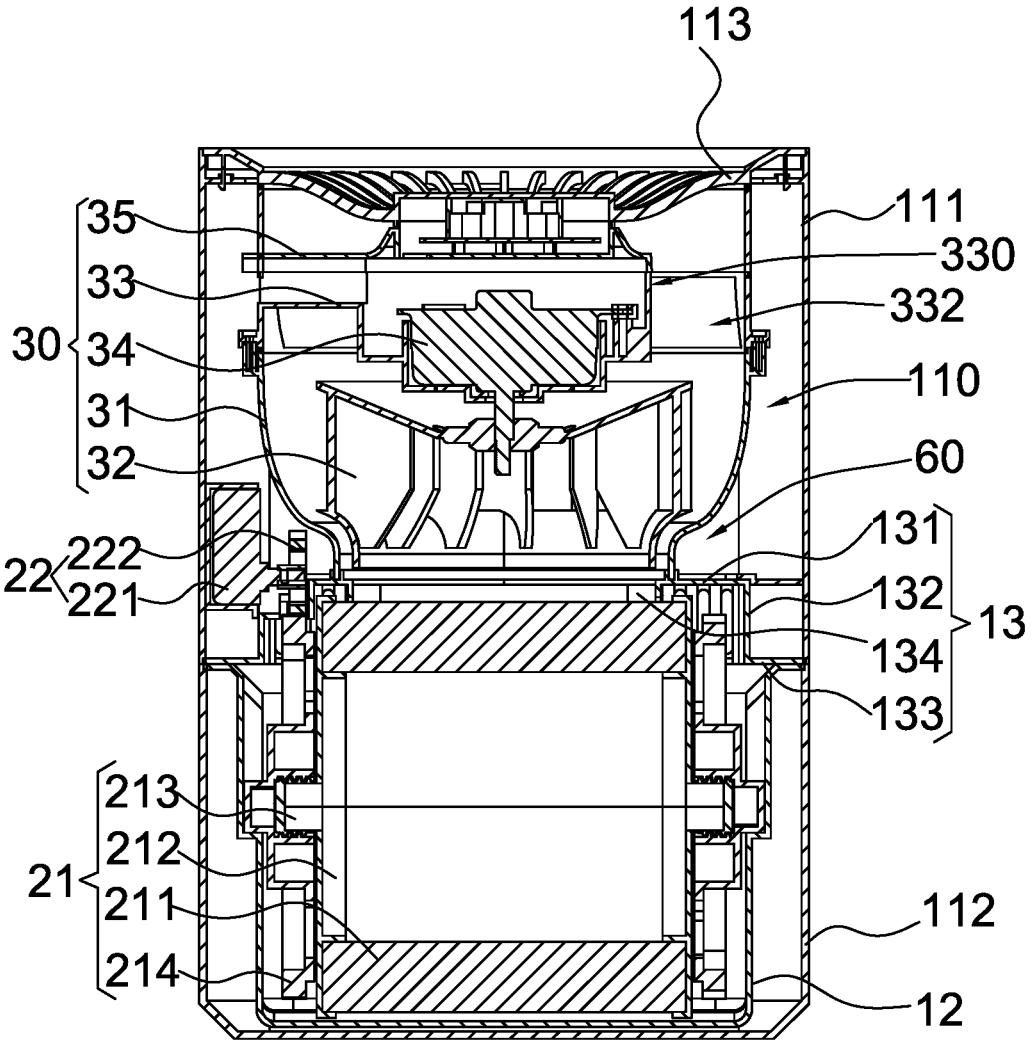
FIG. 8 is a front sectional view of the humidifier according to the preferred embodiment of the present invention.

As shown in FIG. 8 of the drawings, the driving mechanism 22 may be accommodated in the upper housing member 111 while the guiding roller 21 may be accommodated in the lower housing member 112. The upper housing member 111 may be detachably attached on the lower housing member 112 for allow a user to access the water storage compartment 120 and for cleaning the guiding roller 21. Thus, the driving mechanism 22 may be positioned above the guiding roller 21 and the driving gear 222 may be selectively engaged with the corresponding driven gear 214 when the upper housing member 111 is detachably attached on the lower housing member 112.

In this preferred embodiment, a diameter of the driven gear 214 may be greater than that of the driving gear 222 so as to minimize any noise generated by rotation of the guiding roller 21 and to ensure movement stability thereof. For example, a ratio of a driving gear radius to a driven gear radius may be less than or equal to one of 0.8, 0.2, 0.5 or 0.6. The exact relative diameters of the driving gear 222 and the driven gear 214 may depend on the circumstances in which the present invention is manufactured or utilized.

As shown in FIG. 3 and FIG. 4 of the drawings, the driving mechanism 22 may further comprise another driven gear 214, wherein the two driven gears 214 may be mounted on two reinforcing frames 212 respectively. The driving gear 222 may be arranged to engage with one of the driven gears 214 for driving the water absorbing roller member 211 to rotate. When the water absorbing roller member 211 rotates in the water storage compartment 120 filled with a predetermined of water, the water absorbing roller member 211 may absorb the water and mix with the air drawn from the air inlet 1101.

In order to facilitate easy mounting of the guiding roller 21 in the water storage compartment 120, the water tank 12 may further have a plurality of guiding slots 123 indently formed on two sidewalls 124 thereof, wherein the guiding roller 21 may be rotatably coupled to the guiding slots 123 through the use of the connecting shafts 213 for rotatably mounting the guiding roller 21 in the water storage compartment 120. It is worth mentioning that the connecting shafts 213 may be formed on the driven gears 214 and/or the reinforcing frames 212. As shown in FIG. 4 of the drawings, the connecting shafts 213 may be formed on the driven gears 214.

Figure 5:
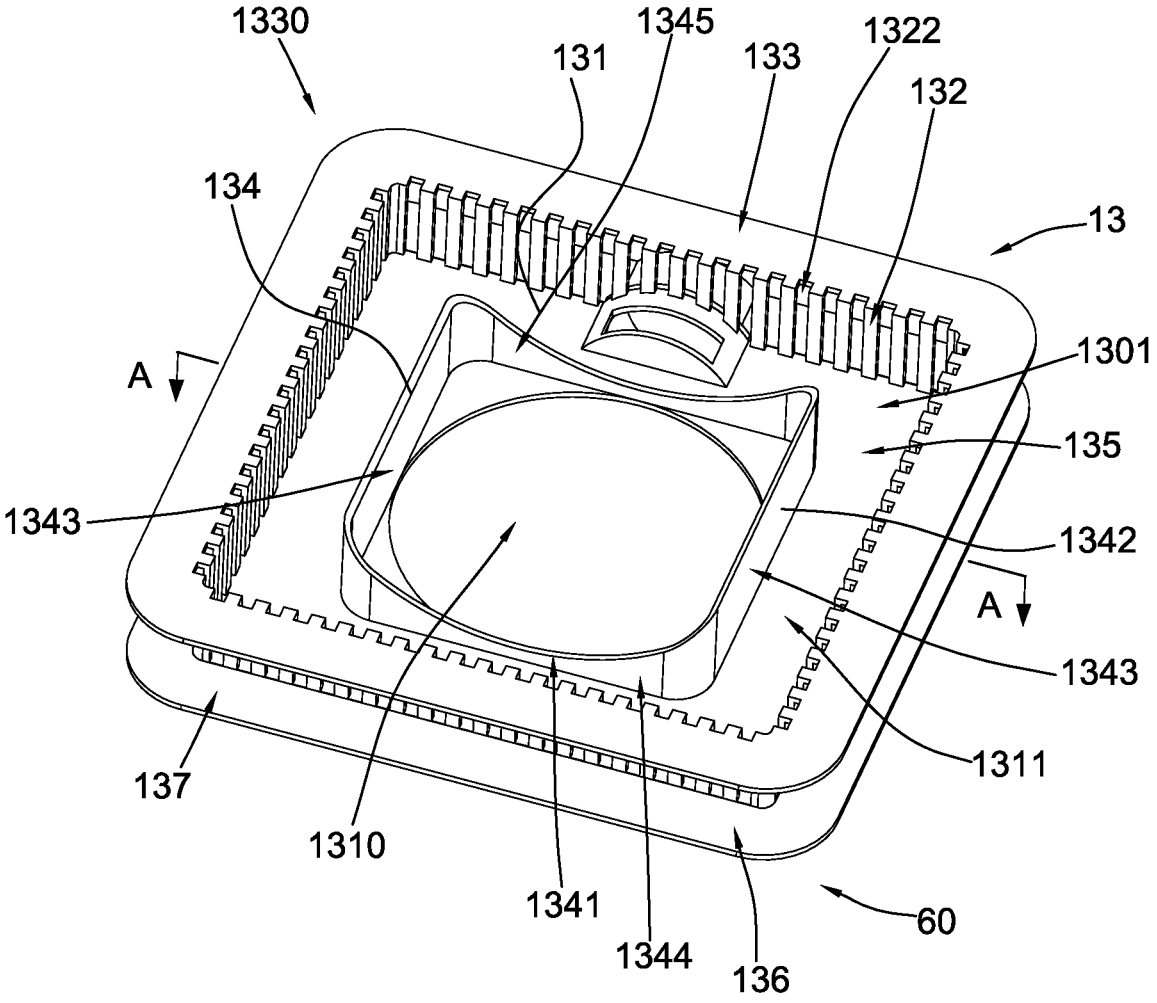
FIG. 5 is perspective view of a partitioning assembly of the humidifier according to the preferred embodiment of the present invention.
Figure 6:
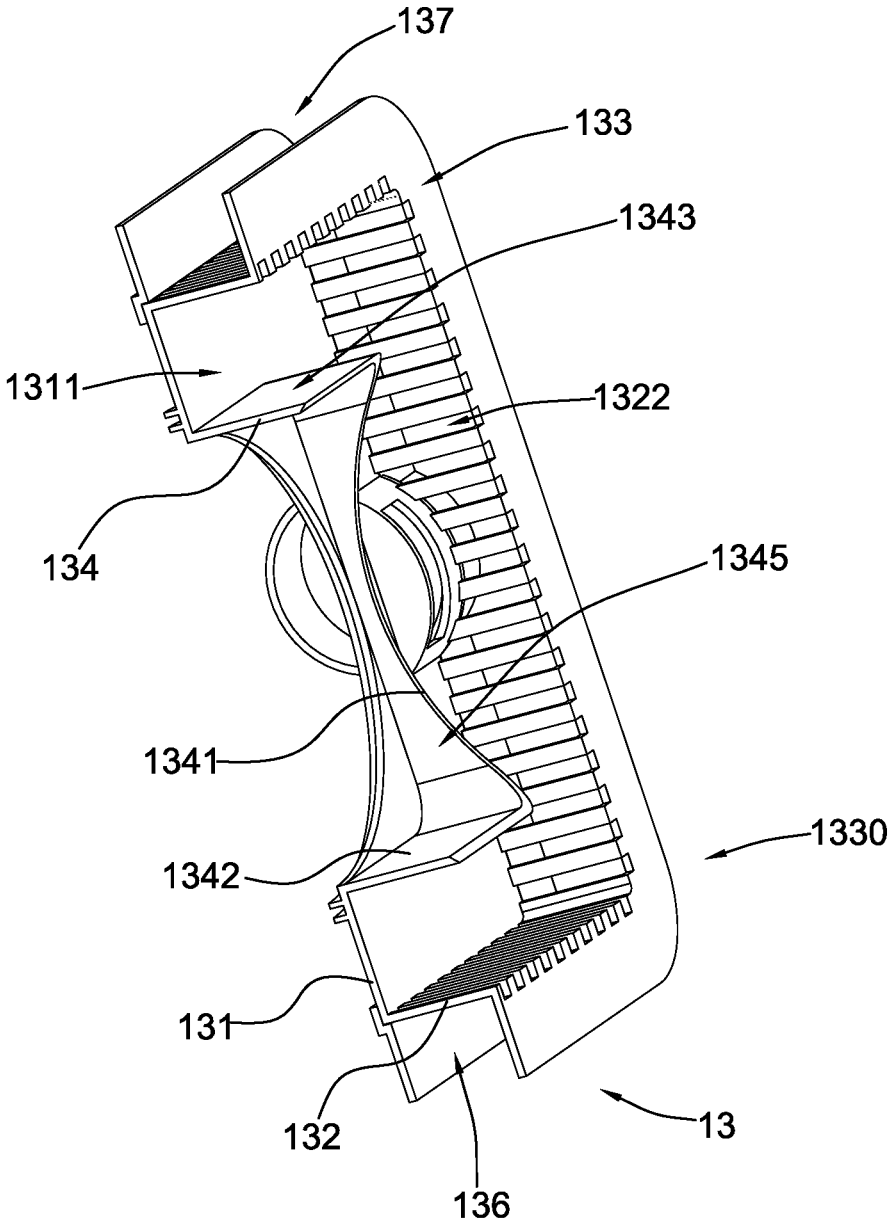
FIG. 6 is a partial perspective view of the partitioning assembly of the humidifier according to the preferred embodiment of the present invention.
Figure 7:
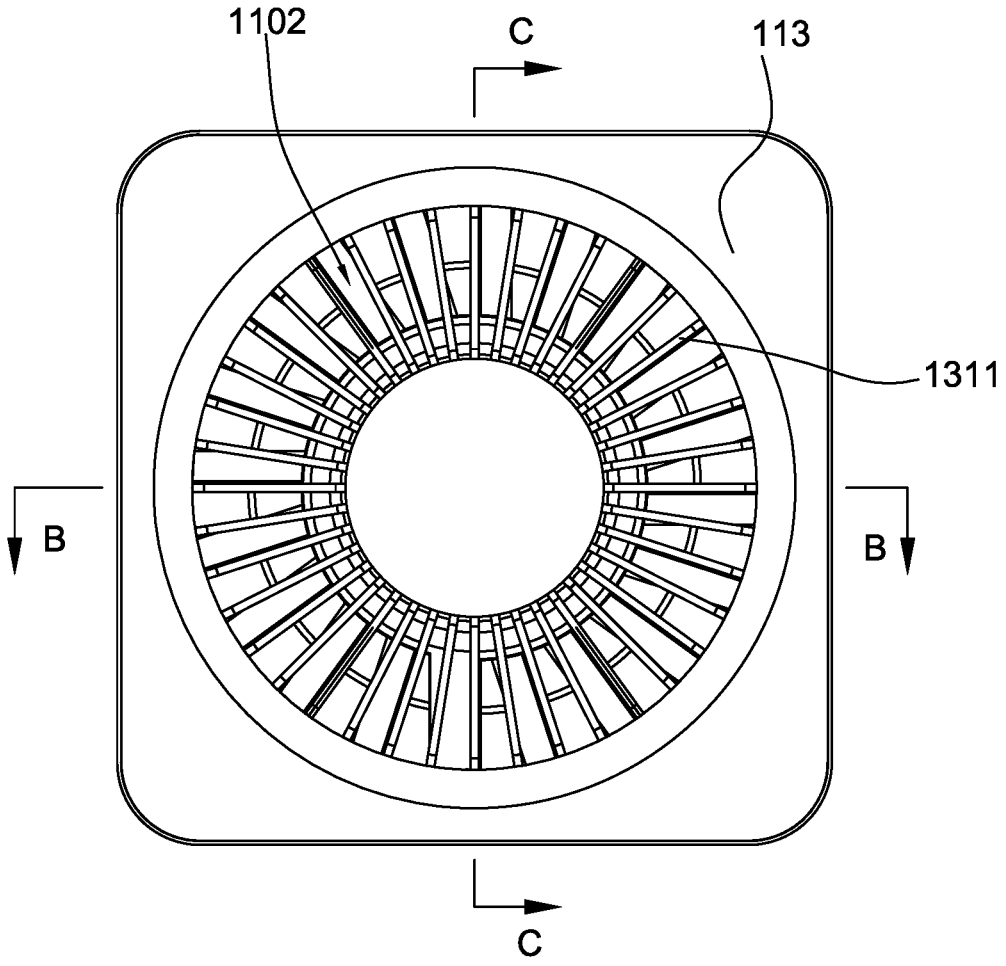
FIG. 7 is a top view of the humidifier according to the preferred embodiment of the present invention.

Referring to FIG. 5 and FIG. 6 of the drawings, the partitioning assembly 13 may comprise a first partitioning member 131, and a second partitioning member 1330 extended from the first partitioning member 131. The partitioning assembly 13 may be configured to have a hollow structure so that it may have a central cavity 135 formed as a space surrounded by the first partitioning member 131 and the second partitioning member 1330. Moreover, the first partitioning member 131 may have a through hole 1310 formed thereon, wherein the through hole 1310 may communicate with the central cavity 135.

The second partitioning member 1330 may have a boundary portion 132 and a lower peripheral rim portion 133 peripherally and outwardly extended from the boundary portion 132. Moreover, the partitioning assembly 13 may further comprise an upper peripheral rim 136 peripherally and outwardly extended from the first partitioning member 131. Thus, a groove 137 may be formed as a space surrounded by the upper peripheral rim 136, the lower peripheral rim portion 133, and an outer surface 1321 of the boundary portion 132.

In this preferred embodiment of the present invention, the air inlet 1101 may be formed on the main housing 11 at a position between the first partitioning member 131 and the peripheral rim portion 133 (i.e. a position corresponding to the groove 137), so that the air drawn from the air inlet 1101 may be effectively guided to flow into the groove 137.

Accordingly, the boundary portion 132 may have a plurality of air slots 1322 spacedly formed thereon, wherein the air slots 1322 may communicate the groove 137 with the central cavity 135. Thus, air flowing through the air inlet 1101 may be guided to flow into the groove 137 and enter the central cavity 135 through the air slots 1322. The boundary portion 132 may be configured from rigid material which may reinforce the overall structure of the partitioning assembly 13 so that the partitioning assembly 13 may have the necessary structural strength to support the fan unit 30 thereabove.

The partitioning assembly 13 may be utilized to separate the water storage compartment 120 from the fan unit 30 so as to ensure optimal performance when mixing water with air. In this preferred embodiment, the water storage compartment 120 and the guiding roller 21 may be positioned underneath the second partitioning member 1330, while the fan unit 30 may be positioned above the first partitioning member 131. This configuration may be illustrated in FIG. 8 of the drawings.

The partitioning assembly 13 may further comprise a securing piece 134 extended from a bottom surface 1311 of the first partitioning member 131 and secured in the central cavity 135. The securing piece 134 may extend from the bottom surface 1311 on a boundary enclosing the through hole 1310 in the central cavity 135. Moreover, the securing piece 134 may have a side boundary 1342 extending in the central cavity 135. Thus, when viewed from the bottom, the securing piece 134 may have a cross section enclosing that of the through hole 1310. This structure is shown in FIG. 5 of the drawings.

The side boundary 1342 may have two side portions 1343, a front portion 1344 and a rear portion 1345. Moreover, the securing piece 134 may have a plurality of bottom edges 1341 formed on the front portion 1344 and the rear portion 1345 respectively. The bottom edges 1341 may have curved contour, in which a radius of curvature of the bottom edges 1341 may correspond to a radius of curvature of the water absorbing roller member 211. In this preferred embodiment of the present invention, two of the bottom edges 1341 may be concavely curved (as viewed from bottom) in which the radius of curvature may correspond to that of the radius of curvature of an external surface of the water absorbing roller member 211. Because of the match of the surface contour of the water absorbing roller member 211 and the bottom edges 1341 of the securing piece 134, air flowing within the main housing 11 may be kept stable and the noise thus generated may be kept to the minimum. Moreover, the curved bottom edges 1341 may also help to minimize the amount of air flowing out of the through hole 1310 without mixing with the water absorbed by the water absorbing roller member 211.

The through hole 1310 may communicate with the air outlet 1102 through the fan unit 30 so that air in the water storage compartment 120 may be arranged to mix with the water while the water absorbing roller member 211 is being rotated. The mixture of air and water may then become mist and blown out of the main housing 11 through the air outlet 1102 by the fan unit 30. According to the preferred embodiment of the present invention, the main frame 31 may have a through opening 313 formed at a bottom portion thereof, wherein the through opening 313 may communicate with the through hole 1310 of the partitioning assembly 13. As a result, air and water mixture in the form of mist may be able to flow out of the water storage compartment 120 and may be arranged to pass through the through hole 1310, the through opening 313 of the main frame 31, and eventually flow out of the main housing 11 through the air outlet 1102.

As briefly described above, air may be drawn to enter the main housing 11 through the air inlet 1101. The air may then pass through the air slots 1322 and enter the central cavity 135. The air passing through the central cavity 135 may be arranged to pass through the ventilating hole 2120 of the corresponding reinforcing frame 212 (i.e. the reinforcing frame nearest to the air inlet 1101) to reach the water-soaked water absorbing roller member 211. The air reaching the water-soaked water absorbing roller member 211 may mix with the water to form a predetermined amount of mist or water vapor. The mist or water vapor may be driven by the fan unit 30 to pass through the through hole 1310 and the air conduits 333 and eventually exit the main housing 11 through the air outlet 1102.

It is worth mentioning that the use of the securing piece 134 may allow air drawn from the air inlet 1101 to be effectively guided to flow to the water storage compartment 120 and to mix with the water soaked in the water absorbing roller member 211.

Furthermore, when the water absorbing roller member 211 rotates, dust from the air may be trapped or blocked by the water-soaked water absorbing roller member 211 and the air discharged out of the main housing 11 may be filtered by this mechanism.

The water absorbing roller member 211 and the securing piece 134 may be shaped and sized and positioned to minimize clearance between these two components. For example, the water absorbing roller member 211 may be partially received in the securing piece 134 so that the reinforcing frames 212 are positioned between the side portions 1343 of the side boundary 1341 of the securing piece 134. A horizontal distance between each of reinforcing frames 212 and the corresponding side portion 1343 of the side boundary 1341 may be less than one of 5 mm, 3 mm, 2 mm, 1 mm or 0.5 mm. Moreover, a vertical distance between the water absorbing roller member 211 and the front portion 1344 and the rear portion 1345 of the side boundary 1341 of the securing piece 134 may be less than one of 5 mm, 3 mm, 2 mm, 1 mm or 0.5 mm.

Figure 11:
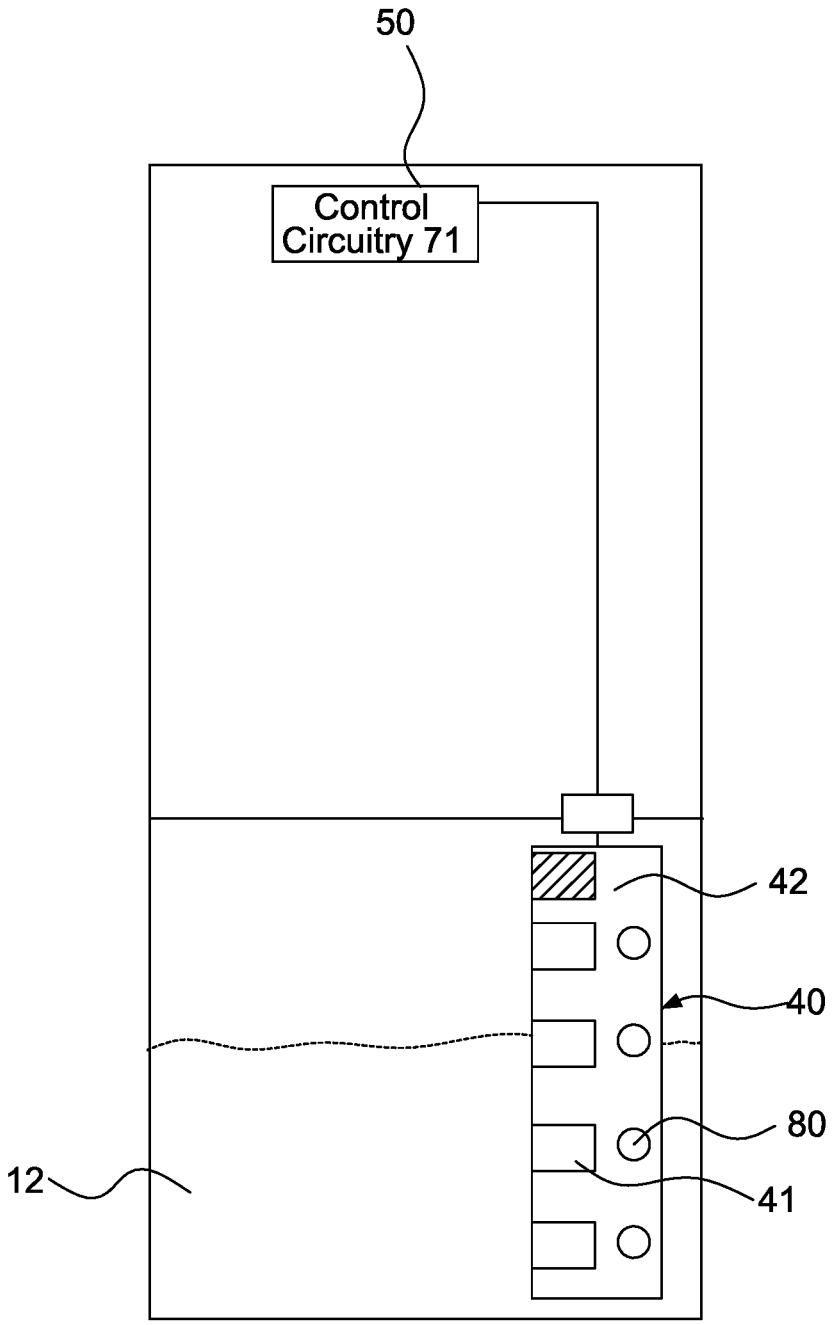
FIG. 11 is a schematic diagram of a water level sensing apparatus of the humidifier according to the preferred embodiment of the present invention.
Figure 12:
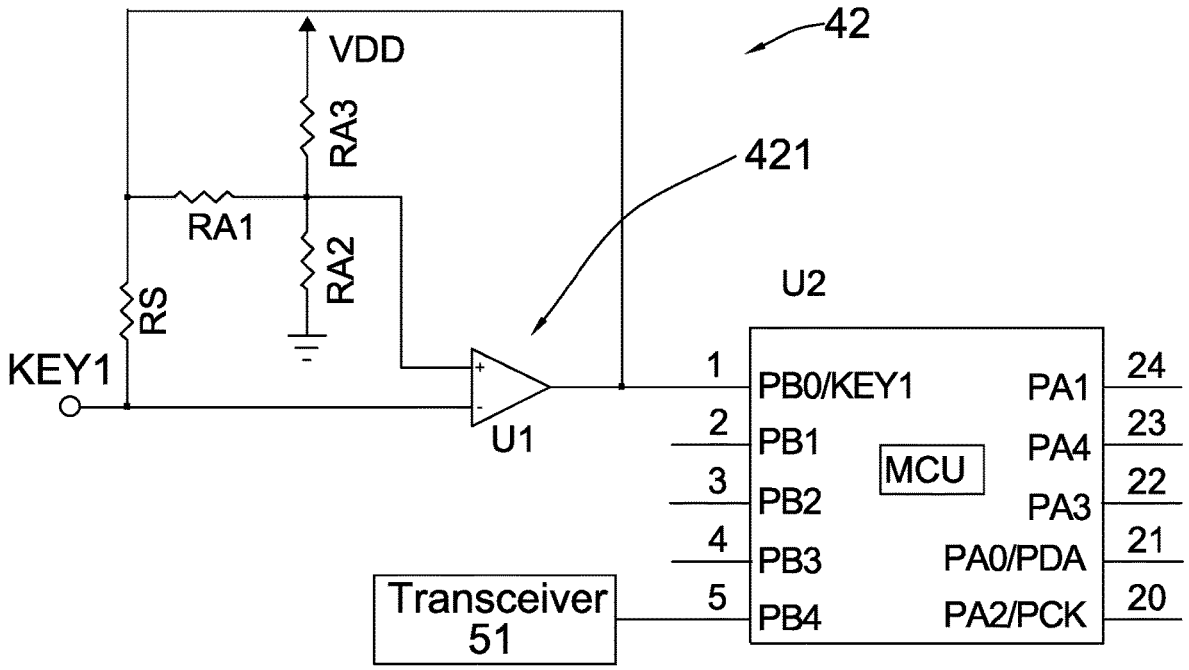
FIG. 12 is an electrical diagram of a sensor circuitry of the humidifier according to the preferred embodiment of the present invention.

Referring to FIG. 11 to FIG. 12 of the drawings, the humidifier may further comprise a water level sensing apparatus 40. The water level sensing apparatus 40 may comprise a plurality of water level sensors 41 mounted on the water tank 12 and a sensor circuitry 42 electrically connected to the water level sensors 41. The water level sensors 41 may be spacedly distributed on the water tank 12 along a vertical direction thereof. When the water storage compartment 120 is filled with water, the water and the corresponding water level sensors 41 may form a capacitance which may create an electrical signal in the sensor circuitry 42. As a result, the water level in the water tank 12 may be obtained by the sensor circuitry 42. The sensor circuitry 42 may be implemented on a sensor Printed Circuity Board (sensor PCB 421) mounted in the main housing 11.

The humidifier may further comprise at least one illuminator 80 electrically connected to the sensor circuitry 42 for indicating water level of as detected by the water level sensors 41. The humidifier may further comprise at a transceiver 51 electrically connected to the sensor circuitry 42 for wirelessly transmitting water level status to a paired terminal device, such as a smartphone. The information thus transmitted may be used to alert user to refill water when the water level in the water storage compartment 120 falls below a predetermined threshold.

The sensor circuitry 42 may comprise an amplifier 421 and a microprocessor 422 electrically connected to the amplifier 421. The water level sensors 41 may be electrically connected to a single amplifier 421. Alternatively, each of the water level sensors 41 may have a dedicated amplifier 421. An exemplary configuration of the sensor circuitry 42 may be illustrated in FIG. 12.

As shown in FIG. 3 of the drawings, the electrical connection between the electrical components in the lower housing member 112 and the upper housing member 111 may be accomplished by a plurality of connecting pins 121 formed on the lower housing member 112 and the upper housing member 111. The connecting pins 121 on the lower housing member 112 may be provided on an engaging protrusion 122. The connecting pins 121 may also be provided on the partitioning assembly 13. When the upper housing member 111 is detachably attached on the lower housing member 112, the connecting pins 121 on the lower housing member 112 may come into contact with the connecting pins 121 on the upper housing member 111 so as to electrically connect the electrical components (such as providing power) received in the upper housing member 111 and the lower housing member 112.

The humidifier may further comprise a control panel 70 provided on the main housing 11 and electrically connected to the control circuitry 71 which may be implemented on the control PCB 50 for allowing a user to control an operation of the humidifier through operating on the control panel 70. The control panel 70 may be provided on at least one of the upper housing member 111 and the lower housing member 112.

The operation of the present invention is as follows: a user of the present invention may fill the water tank 12 with a predetermined amount of water, and attach the upper housing member 111 on the lower housing member 112. The fan unit 30 and the guiding roller 21 may be switched on. Ambient air may be drawn from the air inlet 1101 and may be arranged to pass through the air slots 1322 of the partitioning assembly 13. The air may then be guided to enter the water storage compartment 120 and come into contact with the water absorbing roller member 211. The rotational movement of the water absorbing roller member 211 may mix the water with the air to form a stream of water vapor or mist. The stream of water vapor or mist may then be driven by the fan unit 30 to pass through the through hole 1310, the air conduits 333, and may be discharged out of the main housing 11 through the air outlet 1102.

Note that with the use of the partitioning assembly 13 and the strategic positioning of the air inlet 1101 on the main housing 11 (as mentioned above), ambient air drawn to pass through the air inlet 1101 may be effectively guided to exclusively enter the water storage compartment 120 so that almost all the air drawn from the air inlet 1101 may be arranged to mix with the water. The air drawn through air inlet 1101 is not allowed to freely flow in the main housing 11. This arrangement effectively increase an efficiency of the air-water mixing mechanism and therefore significantly enhance an overall efficiency of the humidifier of the present invention.

Embodiments of the present disclosure, while illustrated and described in terms of disclosed embodiments and several alternatives, is not limited to the particular description contained in this specification. Additional alternative or equivalent components could also be used to practice embodiments of the present disclosure.

What is claimed is:

1. A humidifier, comprising:

a main housing having an air inlet, an air outlet, a receiving cavity, and a water storage compartment for storing a predetermined amount of water;

a fan unit supported in said main housing for drawing air to flow from said air inlet to said air outlet; and an air guiding arrangement, which comprises:

a guiding roller rotatably supported in said water storage compartment of said main housing, said guiding roller comprising a water absorbing roller member rotatably mounted in said water storage compartment, said water absorbing roller member being configured from rolling a predetermined water absorbing material having a plurality of meshes to form a substantially tubular structure; and a partitioning assembly supported in said receiving cavity of said main housing at a position adjacent to said guiding roller to substantially enclose said water storage compartment, said partitioning assembly defining at least one air slot and an air passage channel, wherein when said fan unit and said guiding roller are driven to rotate, air is drawn from said air inlet and guided to pass through said air slot to reach said water storage compartment for effectively mixing with said water in said water storage compartment to form a predetermined amount of mist, said mist being arranged to pass through said partitioning assembly through said air passage channel and said fan unit, and eventually discharged out of said main housing through said air outlet.

2. The humidifier, as recited in claim 1, wherein said guiding roller further comprises a plurality of reinforcing frames mounted on two ends of said water absorbing roller member respectively for reinforcing a structural integrity thereof and for facilitating mounting of said water absorbing roller member on said water tank, at least one of said reinforcing frames having at least one ventilating hole for facilitating air ventilation and passage of air from said air inlet to said water storage compartment.

3. The humidifier, as recited in claim 2, wherein said air guiding arrangement further comprises a driving mechanism mounted in said main housing and coupled to said guiding roller for driving said guiding roller to rotate in said water storage compartment, said driving mechanism comprising a driving motor and a driving gear coupled to said driving motor.

4. The humidifier, as recited in claim 3, wherein said guiding roller further comprises at least one driven gear operatively coupled to a corresponding reinforcing frame, and arranged to engage with said driving gear of said driving mechanism, so that when said driving motor is operated, said driving gear is also driven to rotate which in turn drives said driven gear to rotate as well.

5. The humidifier, as recited in claim 4, wherein said partitioning assembly comprises a first partitioning member, and a second partitioning member extended from said first partitioning member, said partitioning assembly being configured to have a hollow structure and form a central cavity as a space surrounded by said first partitioning member and said second partitioning member, said first partitioning member having a through hole communicating with said central cavity.

6. The humidifier, as recited in claim 5, wherein said second partitioning member has a boundary portion and a lower peripheral rim portion peripherally and outwardly extended from said boundary portion, said partitioning assembly further comprising an upper peripheral rim peripherally and outwardly extended from said first partitioning member to form a groove as a space surrounded by said upper peripheral rim, said lower peripheral rim portion, and an outer surface of said boundary portion.

7. The humidifier, as recited in claim 6, wherein said air inlet is formed on said main housing at a position between said first partitioning member and said peripheral rim portion at a position corresponding to said groove, so that said air drawn from said air inlet is capable of being effectively guided to flow into said groove.

8. The humidifier, as recited in claim 7, wherein said boundary portion has a plurality of air slots spacedly formed thereon, said air slots communicating said groove with said central cavity so that air flowing through said air inlet is guided to flow into said groove and enter said central cavity through said air slots.

9. The humidifier, as recited in claim 1, wherein said partitioning assembly comprises a first partitioning member, and a second partitioning member extended from said first partitioning member, said partitioning assembly being configured to have a hollow structure and form a central cavity as a space surrounded by said first partitioning member and said second partitioning member, said first partitioning member having a through hole communicating with said central cavity.

10. The humidifier, as recited in claim 9, wherein said second partitioning member has a boundary portion and a lower peripheral rim portion peripherally and outwardly extended from said boundary portion, said partitioning assembly further comprising an upper peripheral rim peripherally and outwardly extended from said first partitioning member to form a groove as a space surrounded by said upper peripheral rim, said lower peripheral rim portion, and an outer surface of said boundary portion.

11. The humidifier, as recited in claim 10, wherein said air inlet is formed on said main housing at a position between said first partitioning member and said peripheral rim portion at a position corresponding to said groove, so that said air drawn from said air inlet is capable of being effectively guided to flow into said groove.

12. The humidifier, as recited in claim 11, wherein said boundary portion has a plurality of air slots spacedly formed thereon, said air slots communicating said groove with said central cavity so that air flowing through said air inlet is guided to flow into said groove and enter said central cavity through said air slots.

13. The humidifier, as recited in claim 12, wherein said water storage compartment and said guiding roller are positioned underneath said second partitioning member, while said fan unit is positioned above said first partitioning member.

14. The humidifier, as recited in claim 13, wherein said partitioning assembly further comprises a securing piece extended from a bottom surface of said first partitioning member and secured in said central cavity, said securing piece extending from said bottom surface on a side boundary enclosing said through hole in said central cavity.

15. The humidifier, as recited in claim 14, wherein said side boundary has two side portions, a front portion and a rear portion, said securing piece having a plurality of bottom edges formed on said front portion and said rear portion respectively, said bottom edges having curved contour, in which a radius of curvature of said bottom edges corresponds to a radius of curvature of said water absorbing roller member.

* * * * *